US010086528B2

(12) United States Patent
Baratta

(10) Patent No.: US 10,086,528 B2
(45) Date of Patent: Oct. 2, 2018

(54) CHAIN BAR APPARATUS AND METHODS

(75) Inventor: Anthony Baratta, Oak Park, CA (US)

(73) Assignee: Baron Investments LLC, Oxnard, CA (US)

( * ) Notice: Subject to any disclaimer, the term of this patent is extended or adjusted under 35 U.S.C. 154(b) by 0 days.

(21) Appl. No.: 13/388,054

(22) PCT Filed: Jul. 21, 2010

(86) PCT No.: PCT/US2010/042819

§ 371 (c)(1),
(2), (4) Date: Jan. 30, 2012

(87) PCT Pub. No.: WO2011/014396

PCT Pub. Date: Feb. 3, 2011

(65) Prior Publication Data

US 2012/0176806 A1 Jul. 12, 2012

Related U.S. Application Data

(60) Provisional application No. 61/229,940, filed on Jul. 30, 2009.

(51) Int. Cl.
*B27B 17/02* (2006.01)

(52) U.S. Cl.
CPC ..... *B27B 17/02* (2013.01); *Y10T 29/49826* (2015.01); *Y10T 156/10* (2015.01)

(58) Field of Classification Search
CPC ..... B27B 17/00; B27B 17/02; B27B 17/025
USPC ..... 30/381–387; 362/119, 120
See application file for complete search history.

(56) References Cited

U.S. PATENT DOCUMENTS

| | | | | |
|---|---|---|---|---|
| 2,962,061 | A | 11/1960 | Nielsen | |
| 3,545,505 | A * | 12/1970 | Deweese et al. | 83/821 |
| 4,393,590 | A | 7/1983 | Pantzar | |
| 4,837,934 | A | 6/1989 | Krohn | |
| 5,271,157 | A | 12/1993 | Wieninger et al. | |
| 5,426,854 | A | 6/1995 | Leini | |
| 5,666,734 | A * | 9/1997 | Morrison | B27B 17/025 30/383 |
| 5,669,140 | A | 9/1997 | Tsumura | |
| 5,842,279 | A | 12/1998 | Andress et al. | |
| 5,845,402 | A | 12/1998 | Leini | |
| 6,939,022 | B2 * | 9/2005 | Brooks | 362/120 |
| 7,452,097 | B1 * | 11/2008 | Dunbar | 362/119 |
| 7,758,201 | B2 * | 7/2010 | Hsieh | 362/109 |

(Continued)

FOREIGN PATENT DOCUMENTS

| | | | |
|---|---|---|---|
| DE | 10 2006 036 433 | * | 4/2007 |
| DE | 10 2008 000514 | * | 9/2009 |

(Continued)

OTHER PUBLICATIONS

Copenheaver, Blaine R., International Search Report for PCT/US2010/042819 dated Sep. 15, 2010.

*Primary Examiner* — Hwei C Payer
(74) *Attorney, Agent, or Firm* — Henricks Slavin LLP

(57) ABSTRACT

Chain bar apparatus and methods are disclosed that may be formed from plastic, metal or other materials. Laser cutting of a chain bar core can provide improved structural characteristics, for example when adhesive is used to assemble the chain bar. Flow diversion elements can be used to optimize flow throughout the chain bar.

18 Claims, 7 Drawing Sheets

(56) References Cited

U.S. PATENT DOCUMENTS

| | | | | |
|---|---|---|---|---|
| 8,226,275 | B2 * | 7/2012 | Ieda | H04B 10/1141 362/311.01 |
| 9,381,665 | B2 * | 7/2016 | Onose | B27B 17/00 |
| 2002/0054491 | A1 * | 5/2002 | Casas | B25B 23/18 362/119 |
| 2005/0188551 | A1 * | 9/2005 | Magnuson et al. | 30/382 |
| 2005/0248933 | A1 * | 11/2005 | Chen et al. | 362/119 |
| 2008/0247153 | A1 * | 10/2008 | Groover | 362/27 |
| 2012/0176806 | A1 * | 7/2012 | Baratta | B27B 17/02 362/382 |
| 2013/0031793 | A1 * | 2/2013 | Baratta | B27B 17/025 30/387 |
| 2015/0321377 | A1 * | 11/2015 | Onose | B27B 17/00 30/383 |

FOREIGN PATENT DOCUMENTS

| | | | |
|---|---|---|---|
| JP | 2008-49650 | * | 3/2008 |
| JP | 200849650 | | 3/2008 |
| JP | 2013-18232 | * | 1/2013 |

* cited by examiner

CHAIN BAR APPARATUS AND METHODS

CROSS REFERENCE TO RELATED APPLICATIONS

This application is a National Stage of International Application No. PCT/US10/042819, filed Jul. 21, 2010, which claims priority to Provisional Application 61/229,940 filed Jul. 30, 2009, incorporated herein by reference.

BACKGROUND

Field

These inventions relate to chain bars and other support structures for chain cutting instruments.

SUMMARY

Methods and apparatus are disclosed that can be used for chain bars or other support structures (sometimes hereafter referred to as "chain bars") for chain cutting instruments. One or more aspects of the methods and apparatus can be used to improve the manufacture of such structures, as well as to improve the structures themselves. In at least one aspect, the manufacturing cost for a chain bar can be reduced. In at least one aspect, the manufacturing of a chain bar is simplified.

In one example described herein, a chain bar is formed as a laminate of at least two structures, namely an outer plate and a core. The core is configured to extend substantially in the same manner as the outer plate, so that for example the outer plate is formed to be substantially planar, and a substantial portion of the core is also formed to be substantially planar. The core is also formed to include at least one passageway extending through the thickness of the core, such as from one side of the core adjacent the outer plate to the other side of the core opposite the outer plate. In one example, the at least one passageway is formed as a closed circuit not extending to any outer perimeter of the core. An example of a closed circuit includes a nonlinear opening, for example but not by way of limitation an opening having opposing walls spaced apart from each other substantially a constant distance. Another example is a non-circular opening extending in a given direction without intersecting a parameter portion of the core. A further example includes an opening that is asymmetric, and one example of an asymmetric opening includes a serpentine opening. Other configurations of openings may also be used, in addition to or as a substitute for the openings described. In one example, at least one opening is formed in a core of a chain bar and the chain bar is assembled with adhesive extending into the at least one opening. In a further example, adhesive used in constructing a chain bar extends entirely through an opening in the chain bar from one side of the chain bar to another side of the chain bar.

In another example of a laminated chain bar having at least an outer plate and a core, at least one opening extending completely through the core is a laser cut opening. In a method of forming a core for a chain bar, the chain bar includes a core having an opening formed through a laser cutting operation. In one example, the opening is formed so as to be completely internal to a perimeter of the core. In another example, an opening is formed through the core by laser cutting an opening having opposing walls spaced apart from each other a substantially constant distance, and in one example, the opening follows a serpentine path. Many if not all of the openings through the core described herein can be formed in the core by laser cutting. Other methods of forming the openings described herein may also be used.

In a further example of a laminated chain bar having at least an outer plate and a core, water channels or other cooling fluid flow channels may be formed in the core, and adjacent segments of the core can be maintained at a constant spacing from each other even though they are separated by a respective flow channel extending completely through the thickness of the core. In one example, spacing between adjacent segments of the core can be maintained by removable tabs or other spacer elements that can be removed after adjacent core segments are positioned as desired. In one example, flow channels are formed between adjacent core segments and removable spacer elements are formed to maintain a desired spacing between adjacent segments. Forming the channels and/or the tabs can be carried out by laser cutting or other forming techniques. In one example, at least one removable spacer is formed between adjacent core segments and attached at a perimeter portion of the core. In another example, at least one removable spacer is formed to be attached between adjacent core segments interior to a perimeter portion of the core. Other and/or additional steps may be followed to form a core for a chain bar having flow channels that extend completely through the core from one side of the core to an opposite side of the core.

In another example of a laminated chain bar having at least an outer plate and a core, one or both of the outer plate and the core include flow channel configurations having varying flow, for example flow cross-section, configurations as a function of location on the chain bar. The location on the chain bar may be distance from a flow inlet, relative proximity to a flow outlet, relative proximity to a flow branch or other location configurations. In one example, the flow cross-sectional area decreases would distance from a flow inlet. In another example, diversion devices or barriers are placed adjacent flow inlet areas to affect flow in the area of the inlet. Other configurations can be adopted. In another example, and inlet manifold area is optimized for continuous fluid flow, for example with more gradual curvature, shallower angles, or other surface configurations to minimize turbulent flow.

In a further example of a laminated chain bar having at least an outer plate and a core, flow channels can be defined entirely in the core, though the outer plate may form one side of one or more flow channels. For example, an inlet manifold, longitudinal flow channels and lateral flow channels may be formed entirely in the core. Additionally, flow channels to a nose sprocket assembly may also be formed completely in the core, though one side of a flow channel for the sprocket assembly may be defined by a portion of the sprocket assembly or its housing. In one example, a flow channel for the nose sprocket assembly may be formed in a portion of the chain bar core that extends forward and outward of the plane of the core and into a plane of the outer plate. In another example, fluid flow channels through the chain bar flowing to the nose sprocket and to the chain are formed as grooves, channels or other depressions in to the surface of a core element for the chain bar.

In another example of a laminated chain bar having at least an outer plate and a core with fluid flow paths, one or more of the flow paths may include flow diverter's, flow barriers, flow vanes or flow islands within a flow path. These flow structures affect the flow within the flow path. For example, a flow structure can reduce turbulence, direct flow into a lateral channel, direct flow into a central channel, change flow pressure or velocity, or otherwise affect flow characteristics in the flow channel. The flow structure can be configured as a function of the desired flow characteristic at the flow location.

In a further example of a laminated chain bar having a core with fluid flow paths, the chain bar can include one or more flow control valves. In one configuration, a flow control valve is used to prevent backflow. For example, in many chain bars, only one of two flow inlet's is used at any given time, and a flow control valve can be used to reduce fluid flow to the unused inlet. A flow control valve can be active or passive. In one example, the valve configuration can be set by the predominant inlet flow configuration. In another example, the valve configuration can be set manually, hydraulically, electronically or through other means.

In an additional example of a laminated chain bar having at least an outer plate and a core, the outer plate and core may include one or more inter-engagement elements. In one example, elements on the core may fit into complementary elements in the outer plate, for example bosses on the core fitting into complementary openings in the plate. The bosses and complementary openings may be circular, polygons, asymmetric structures or other configurations. All of a first structure type may be on one of the outer plate and core and all of the complementary structures can be on the other, or the first and complementary structures may be distributed as desired between the outer plate and core. The inter-engagement elements help with registration of the adjacent components and also help with structural integrity of the combination. Such inter-engagement elements are also helpful with outer plate and core elements that are formed from materials different from each other.

In any of the examples described herein of a laminated chain bar, the core can be formed from a plastic unless another material is specifically identified. The plastic can be fiber reinforced, including with any of the materials that may be used to reinforce plastic. Other components of the chain bar can also be made from a number of materials including plastic, with or without reinforcement.

In another example of a laminated chain bar having a core and at least an outer plate, adhesive can be used to form the lamination. Adhesive can also be used to inhibit corrosion on corrosion-problem surfaces. For example, where the at least one outer plate is formed from metal, adhesive applied to the metal outer plate can help to inhibit corrosion. Where the adhesive is a thermoplastic or a thermoset resin, corrosion resistance may be improved over other adhesives. Corrosion resistance may also be improved by using a plastic core.

In a further example of a laminated chain bar having a core and at least one outer plate bonded together using adhesive, bonding strength can be improved by a core bonding surface that is other than uniformly smooth. For example, the core bonding surface can include a surface texture to improve bonding. In one example, the surface texture can be substantially random.

Another example of a laminated chain bar having a core and at least one outer plate has at least one flow channel formed in one or the other of the core and outer plate. The at least one flow channel includes spaced apart sides connected by a connecting structure. The connecting structure can be a bridge, a tab, a pin or other structure helping to keep the two sides apart. The connecting structure is removable, for example through weakened portions between the connecting structure and the adjacent side. The connecting structure can be disconnected by bending, twisting or other weakening motion resulting in disconnection. The connecting structure can be internal to an outer perimeter of the core or outer plate, as the case may be, or may be external to the outer perimeter. An internal connecting structure configuration may enhance the ease of disconnecting the connecting structure.

In an example of a chain bar laminated by placing a core and at least one outer plate adjacent each other, and where at least one flow channel includes spaced apart sides connected by a connecting structure, the laminate can be formed by placing the core and the outer plate adjacent each other so that the flow channel is maintained in a desired configuration by the connecting structure. The connecting structure can be maintained until the spaced apart sides of the flow channel are secured as desired and the flow channel configuration fixed. The connecting structure can then be removed, for example to fully open the flow channel as desired. The connecting structure can be any connecting structure, such as those described herein.

In an example of a method or process that can be used to assemble a chain bar, a core and at least one outer plate are placed adjacent one another where at least one or the other of the core and outer plate includes a flow channel having spaced apart side structures. The side structures are held spaced apart in a desired configuration by a connecting structure as the core and outer plate are laminated. The connecting structure can be removed, for example when the spaced apart structures defining the flow channel are fixed. The connecting structure can be removed for example by bending, twisting or other method for weakening the connecting structure. The connecting structure can be weakened by manipulating the connecting structure from a position outside the perimeter of the side structures defining the flow channel.

A component for a chain bar, for example a core or at least one plate for use in defining a flow channel for the chain bar, can be formed by forming connecting structures for connecting opposite side structures defining a flow channel. The connecting structures can be any of the connecting structures described herein as well as other structures achieving similar functions. The connecting structures can be formed in a number of ways, including laser cutting, water jet cutting, stamping or other forming processes. In one configuration, the connecting structure is formed with a bridge component extending between the spaced apart sides defining the flow channel and also with a manipulating portion connected to the bridge component for disconnecting the connecting structure from the sides defining the flow channel. The bridge component can be positioned within the flow channel, or outside the flow channel. The manipulating portion can extend outside the flow channel, for example outside a perimeter of the chain bar.

A chain bar and one or more components for a chain bar, for example, may be formed by laser cutting one or more laminate of the chain bar and bonding with adhesive or a flowing bonding agent at least a portion of the chain bar such that the adhesive or bonding agent extends at least partly into the laser cut. In another example, one or more components of a chain bar can be formed, for example by laser cutting a core element such that a flow channel extends the entire thickness of the core element. In a further example of a chain bar, a core element can be formed to have all of the flow channels formed in the core element, including those flow channels feeding fluid to a nose sprocket, for example. Flow channels can be formed to extend in the core element where a portion of the core element extends into a plane of a side plate. In other examples of methods for forming a chain bar, flow changing portions such as flow islands, diverter's or channel elements are formed within a flow channel to change the flow characteristics of the fluid around the channel element. Another method of forming a chain bar includes incorporating a flow control valve, for example a backflow valve into the chain bar. Another method of forming a chain bar may include incorporating bosses, or other inter-engagement portions for registering adjacent layers of a laminate with respect to each other. A further method of forming a chain bar may include using adhesive to protect components of the chain bar from the corrosive effects of fluid in the chain bar. Another method of forming a chain bar may include incorporating light producing components into the chain bar so that the light producing components can be used to illuminate a cutting area. In another method, a cutting area can be illuminated by a chain bar where the chain bar is formed at least in part from a translucent material that can transmit light from another part of the equipment.

In another example of a chain bar, light producing elements can be incorporated into the chain bar for illuminating a work area. In one example, LED light sources are mounted onto portions of the chain bar, for example embedded into openings in side surfaces of the chain bar, for illuminating the surrounding area. LED light sources can be powered by current supplied by conductors embedded in the chain bar, for example in fluid flow channels or embedded in a plastic core. Current can be supplied from a current source in the chainsaw, for example through conventional means such as a sparkplug or other electrical source, through a battery in the chainsaw or in the chain bar, through current generated by a pump in a flow channel of the chain bar or through other means. The light source may be turned on and off by a suitable switch, which may be manual, mechanical or some other form. In another example of elimination for a chain bar, a light source can be included in the chain bar or adjacent the chain bar and the chain bar formed from a translucent material that transmits light from the light source to the adjacent area.

These and other examples are set forth more fully below in conjunction with drawings, a brief description of which follows.

DETAILED DESCRIPTION

Figure 1:
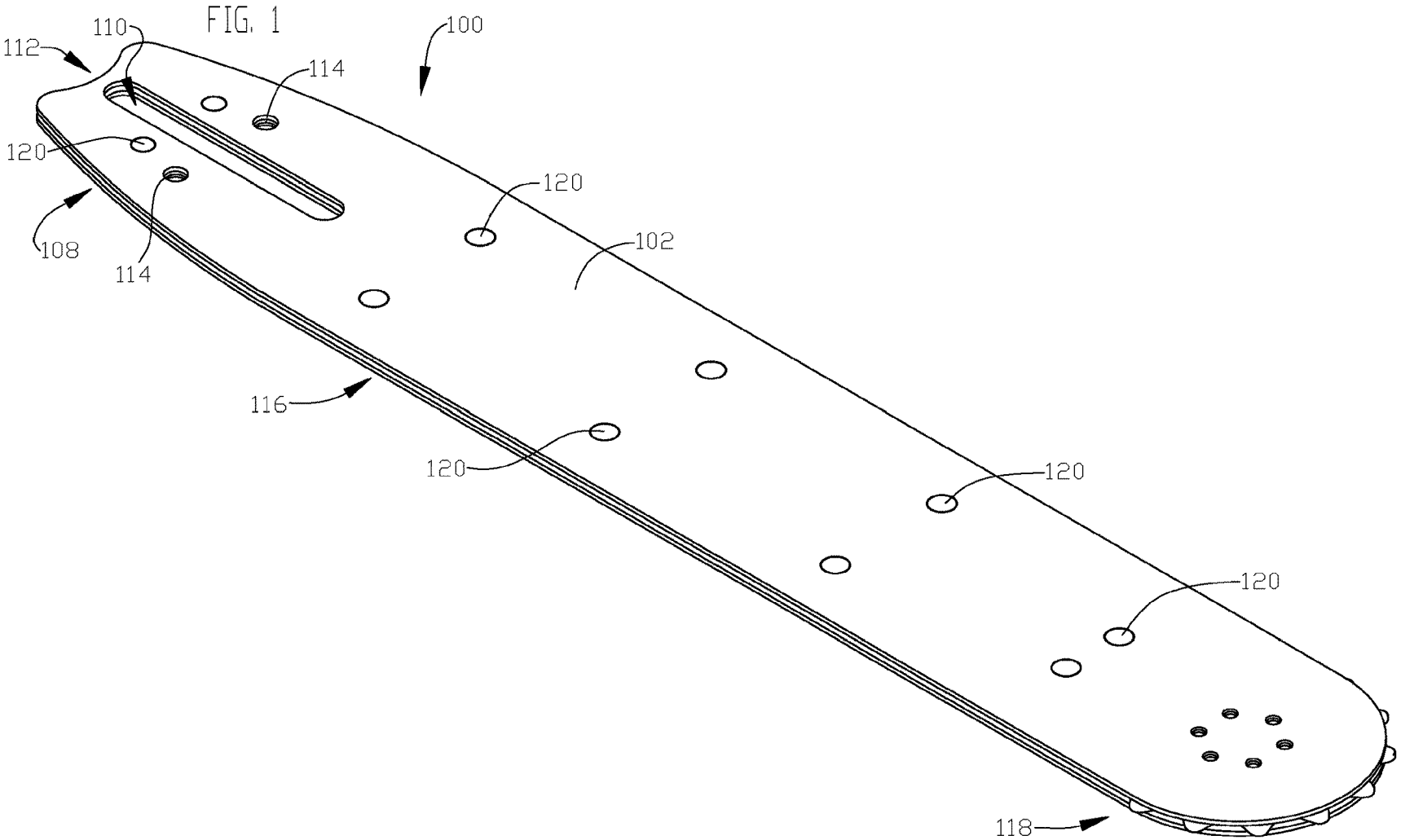
FIG. 1 is an upper right isometric view of a chain bar assembly in accordance with one example described herein.

This specification taken in conjunction with the drawings sets forth examples of apparatus and methods incorporating one or more aspects of the present inventions in such a manner that any person skilled in the art can make and use the inventions. The examples provide the best modes contemplated for carrying out the inventions, although it should be understood that various modifications can be accomplished within the parameters of the present inventions.

Examples of tool components and of methods of making and using the tool components are described. Depending on what feature or features are incorporated in a given structure or a given method, benefits can be achieved in the structure or the method. For example, tool components using fluid for cooling may achieve better cooling and longer lifetime. Cutting tool components may also benefit from lighter-weight components, lower-cost and reduced wear.

Tool components that use water for cooling and/or lubrication may benefit also from one or more features described, for example reducing the possibility of corrosion. Improved corrosion prevention characteristics help component life and promote tool integrity.

Tool components that use water for cooling and/or lubrication may benefit also from one or more features described, for example reducing the possibility of fluid pressure variations adversely affecting the integrity of the tool. Improved fluid pressure characteristics lead to more predicable operation and also promotes tool integrity.

In tool components similar to chain bar configurations, one or more aspects of the examples described may allow better cooling and heat transfer, and improved tool performance. By way of further example, the wear rate may be reduced.

These and other benefits will become more apparent with consideration of the description of the examples herein. However, it should be understood that not all of the benefits or features discussed with respect to a particular example must be incorporated into a tool, component or method in order to achieve one or more benefits contemplated by these examples. Additionally, it should be understood that features of the examples can be incorporated into a tool, component or method to achieve some measure of a given benefit even though the benefit may not be optimal compared to other possible configurations. For example, one or more benefits may not be optimized for a given configuration in order to achieve cost reductions, efficiencies or for other reasons known to the person settling on a particular product configuration or method.

Examples of several tool configurations and of methods of making and using the tool components are described herein, and some have particular benefits in being used together. However, even though these apparatus and methods are considered together at this point, there is no requirement that they be combined, used together, or that one component or method be used with any other component or method, or combination. Additionally, it will be understood that a given component or method could be combined with other structures or methods not expressly discussed herein while still achieving desirable results.

It should be understood that terminology used for orientation, such as front, rear, side, left and right, upper and lower, and the like, are used herein merely for ease of understanding and reference, for example with reference to views in the drawings, and are not used as exclusive terms for the structures being described and illustrated.

A tool component in the form of a chain bar 100 (FIGS. 1-4) is formed as a laminate of two or more components for supporting a cutting chain. The chain bar can be used as part of a chainsaw for cutting wood, concrete or other workpieces, as would be known to one skilled in the art. The assembly and use of a chainsaw with chain bars are well known to those skilled in the art and will not be considered in detail. However, it should be understood that the chain bars described herein can be used with a number of chainsaw configurations as would be appreciated by one skilled in the art.

The chain bar 100 includes a first or top (as viewed in FIGS. 1 and 4) side plate 102 and a second or bottom side plate 104 (as viewed in FIG. 4) forming with a core 106 a laminated chain bar. The chain bar 100 is supported by a chainsaw motor at a mounting end 108 having a mounting and support slot 110, a drive sprocket area 112 for accommodating a drive sprocket and a pair of fluid inlet openings 114. The fluid inlet openings 114 receive fluid such as water for cooling the chain bar and cooling and lubricating the chain bar groove 116 that supports and guides the cutting chain (not shown), and for cooling and lubricating the nose sprocket 118. Additionally, any fluid exiting the chain bar in the area of the cutting chain also cools and lubricates the cutting chain. Because the chain bar 100 is reversible, two fluid inlet openings 114 are provided, only one of which is used at any given time for supplying fluid to the chain bar. The other of the fluid inlet openings receives a chain tightening mechanism to adjust the chain tension. The chain bar laminate assembly is formed so that the chain bar groove 116 has the conventional configuration.

Figure 2:
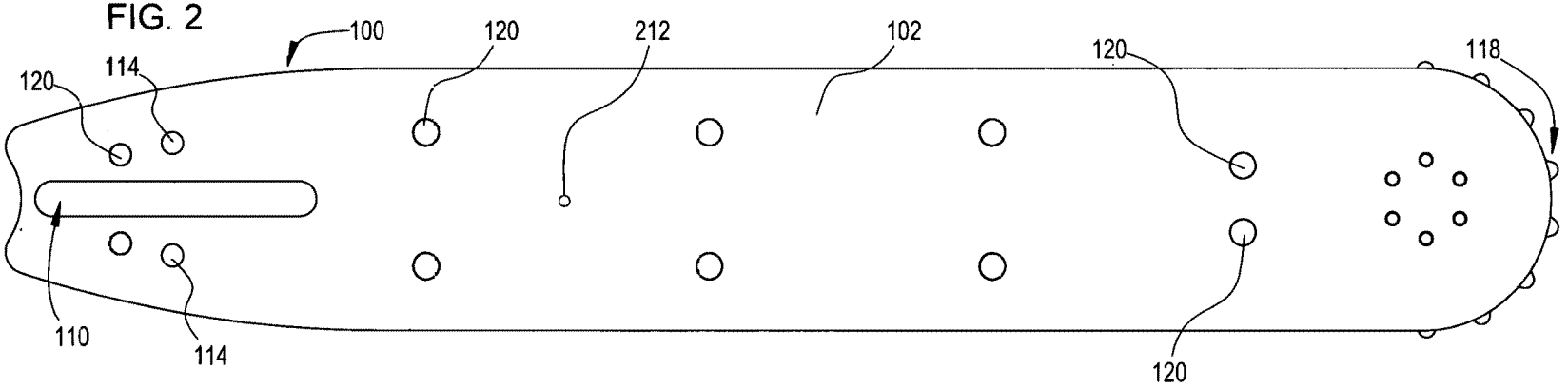
FIG. 2 is a top plan view of the chain bar assembly of FIG. 1.
Figure 3:
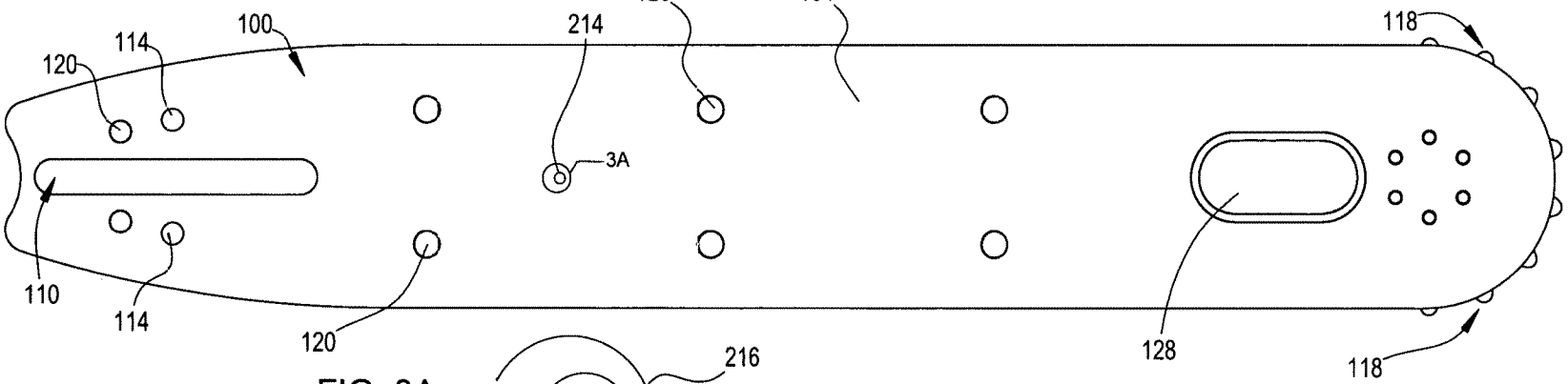
FIG. 3 is a bottom plan view of the chain bar assembly of FIG. 1.

In the example of the chain bar 100 shown in FIGS. 1-12, the chain bar includes a plurality of inter-engagement elements. The inter-engagement elements help to laminate the components of the chain bar to form the final chain bar assembly. The inter-engagement elements help to register adjacent planar components relative to each other. They also help to strengthen the structure, for example by improving the sheer strength of the laminate. In the present examples, the inter-engagement elements are formed from complementary elements in the outer plate 102 and 104 with components in the core 106. In the present example, the inter-engaging elements include a plurality of bosses 120 distributed substantially symmetrically about a central longitudinal axis bisecting the mounting and support slot 110. As shown in FIGS. 1-3, the bosses 120 extend into the side plates 102 and 104. The bosses are also shown in FIGS. 5-10. The bosses extend substantially outward from the core 106, and each of the bosses extend in one direction from the corresponding side of the core 106 opposite a similarly located and configured boss extending outward from the opposite surface, except for the pair of bosses at the nose end of the core 106. The bosses 120 at the nose end are positioned on the core 106 to extend only from the top surface, as viewed in FIG. 5.

The bosses 120 form part of inter-engagement elements to improve the assembly and the structural integrity of the chain bar. Each of the upper and lower side plates 102 and 104 include openings 122 complementary to the respective bosses on the core 106. The openings and the bosses provide registration for adjacent layers and also improved sheer strength for the chain bar. The inter-engagement elements can be shaped to be circular, polygon, asymmetric or other configurations complementary to each other. Other structures in the laminate may also be complementary to each other. While all of the bosses are shown as being located on the core 106 and all of the complementary openings on the first and second side plates 102 and 104, it should be understood that all of the bosses can be on the side plates, or some on the side plates and some on the core with respective complementary inter-engagement elements positioned as appropriate.

The nose sprocket 118 is a conventional sprocket for supporting the chain. The sprocket is supported for movement on bearings 124 (FIG. 4) about a hub 126 secured between the first and second plates 102 and 104 in the conventional manner. The bearings and the sprocket are cooled with fluid from the fluid inlet openings 114.

The first side plate 102 in the present example is substantially flat on both sides and includes the openings as indicated. The second side plate 104 is also substantially flat and substantially the same thickness as the first side plate 102, and includes the openings as indicated. In addition to the slot 110, water inlet openings 114, the complementary openings 122 and the openings for securing the nose sprocket, the second side plate 104 includes an opening 128 (FIGS. 3-4) for receiving and supporting a portion of the core 106, described more fully below. The opening 128 provides space for the portion of the core 106 to extend out of the plane of the core. The opening 128 is substantially oval in the present example. The first and second side plates in the present examples are metal, as in conventional side laminates.

The core 106 (FIGS. 4-12) has a substantially flat bottom surface 130 except for a projection in the form of an outlet manifold 132 (FIGS. 5-7 and 9-10). The outlet manifold 132 extends into the oval opening 128 in the second side plate 104, as described more fully below. The bosses 120 extend substantially normal to the respective surface of the core 106, and our substantially circular in the present examples. The core includes respective water inlet openings 134, corresponding to the water inlet openings 114. The sides of the core other than the distal portion corresponding to the outlet manifold 132 conform substantially to the site configurations of existing chain bar cores, for supporting a cutting chain. Additionally, except for the bosses 120, the outlet manifold 132 and the flow channels described more fully herein, the thickness of the chain bar core 106 is substantially similar to existing chain bar cores.

The core 106 may be formed from a number of materials, including metal, plastic, composite materials and the like. In the present example, the core is formed from a fiber reinforced plastic. In one configuration, the core has good strength characteristics in compression, and the bosses provide good sheer strength. The plastic core is easily formed through conventional molding techniques having the configurations described herein.

The core includes an inlet manifold area 136 (FIGS. 6 and 11) with an inlet channel 138 corresponding to each of the inlet openings 134. The inlet channel 138 has a relatively large cross-sectional area for flow and has a relatively gradual curvature to a flow junction 140. As in substantially all of the flow channels of the chain bar in the present example, the flow cross-sectional area is determined by the depth and width of the flow channel formed into plastic core. The remaining side of the flow channel is closed by the adjacent first plate 102 and the adhesive (not shown) between the two. The flow junction 140 extends from an apex point 142 to an exit area 144, at which point fluid flow continues down a substantially central channel 146, as described more fully below. The gradual curvature of the flow inlet to the junction 140 has a substantially constant radius of curvature to the junction, and minimizes abrupt bends or sharp corners. The cross-sectional flow area of each inlet channel 138 is substantially constant from the respective inlet opening 134 to the apex 142.

Figure 4:
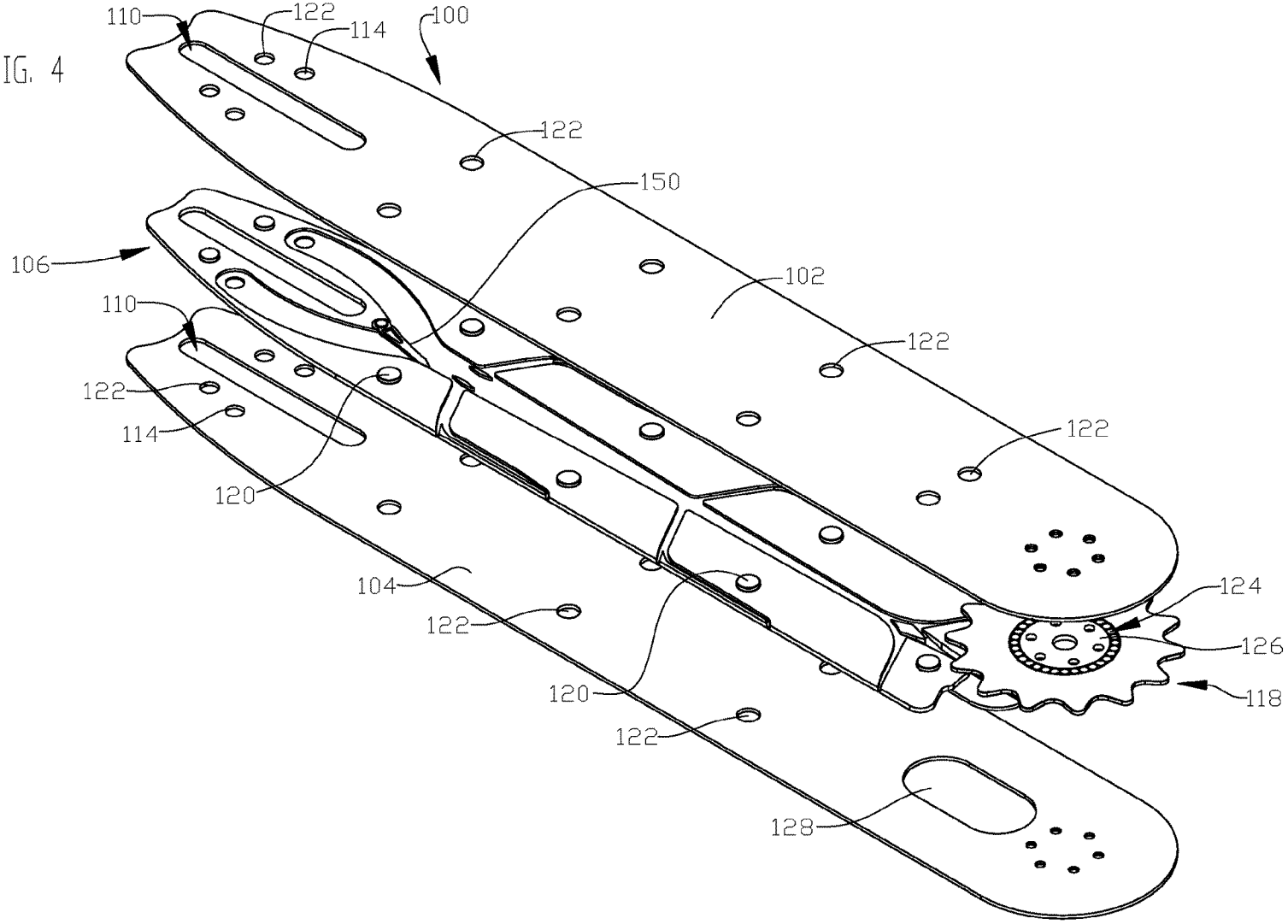
FIG. 4 is an exploded view of the chain bar assembly of FIG. 1.
Figure 15:
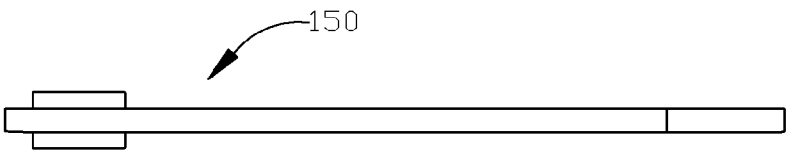
FIG. 15 is a side elevation view of a flow valve in the chain bar shown in FIG. 4.
Figure 16:
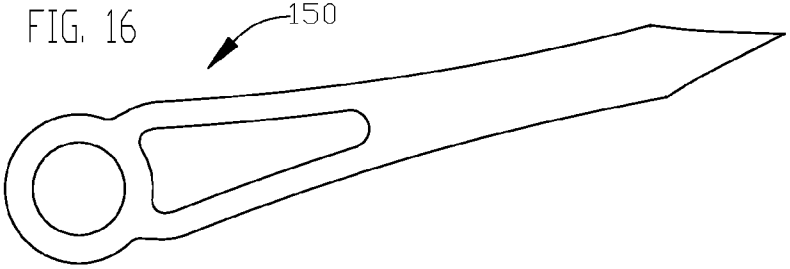
FIG. 16 is a top plan view of the valve of FIG. 15.

The apex point 142 includes an opening 148 for receiving and supporting a flow valve 150 (FIGS. 4 and 15-16). The flow valve 150 pivots freely in the junction area 140 is a function of the direction from which fluid flow is coming. The flow valve 150 serves as a backflow valve reducing the amount of fluid flowing from the inlet channel 138 into the opposite inlet channel 138 (not presently in use for fluid flow). The flow valve also promotes better flow in the remainder of the channel, for example by reducing flow eddies or cavitation.

The central channel 146 extends substantially along a medial or longitudinal axis of the chain bar core. The flow cross-sectional area gradually decreases in the distal direction to the distal end and the outlet manifold 132. The cross-sectional flow area decreases in width but not substantially in depth out to the distal end portion of the core.

Figure 14:
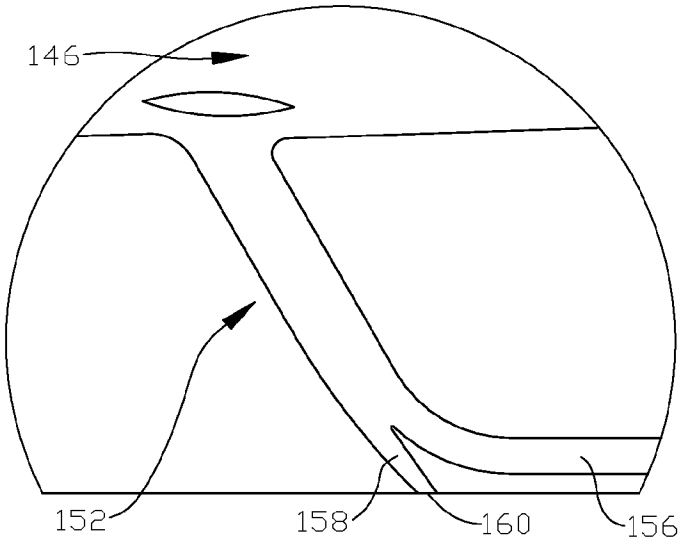
FIG. 14 is a detail of a top plan view of the chain bar core of FIG. 6.
Figure 17:
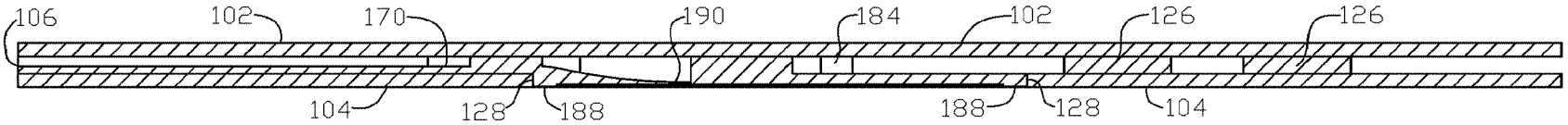
FIG. 17 is a cross-sectional view of a right end of a chain bar assembly omitting the nose sprocket.

Considering the various flow paths in further detail, each side of the core from the media line includes two flow branches 152 and 153, each of which branch again before reaching the lateral edge 154 of the core forming the outer perimeter of the core. Each of the respective branches have respective flow cross-sectional areas less than the upstream flow area from which it came, to maintain flow pressure and velocity for example. As shown in FIG. 14, a first branch 152 from the central channel 146 extends substantially straight at an angle from the central channel to a second smaller branch 156 and to a still smaller branch 158 terminating at an outlet port 160. The second smaller branch 156 terminates in a further outlet port 162 (FIGS. 5-6 and 8) further along the perimeter of the core from the outlet port 160. A similar flow channel arrangement is on the opposite side of the central channel, including with comparable cross-sectional flow areas. The flow branches 153 downstream from the first pair of flow branches 152 have a similar layout but smaller flow cross-sectional areas.

Figures 5, 6, 7, 8, 9, 10:
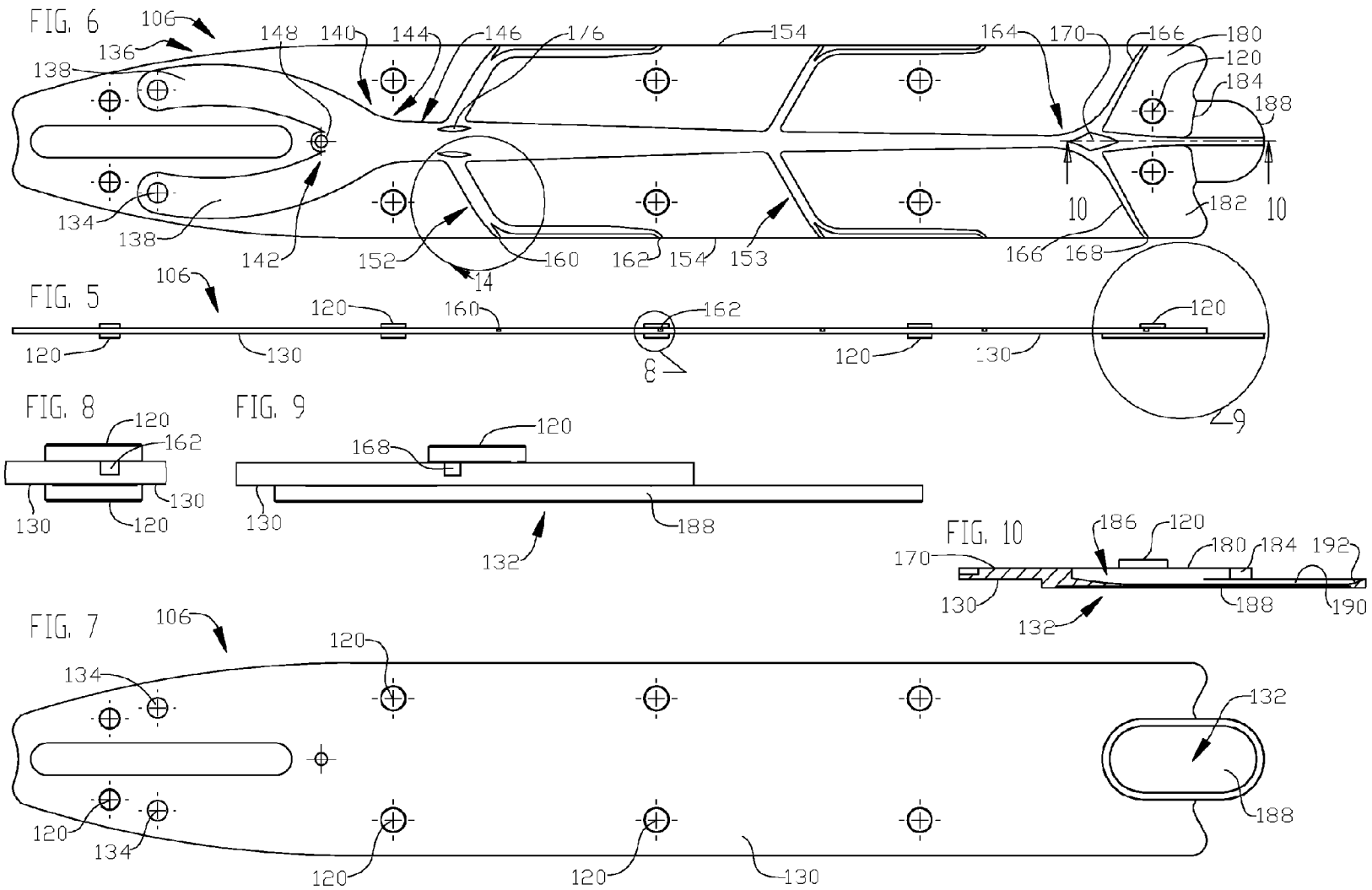
FIG. 5 is a front elevation view of a core element of the chain bar assembly of FIG. 1.
FIG. 6 is a top plan view of the core element of FIG. 5.
FIG. 7 is a bottom plan view of the core element of FIG. 5.
FIG. 8 is a detailed view of a portion of the side of the chain bar core of FIG. 5 showing upper and lower bosses and a fluid flow channel.
FIG. 9 is a detailed view of a portion of the side of the chain bar core of FIG. 5 showing the nose end portion of the core.
FIG. 10 is a partial cross-sectional view of the core of FIG. 5 taken along line 10-10 of FIG. 6.
Figure 11:
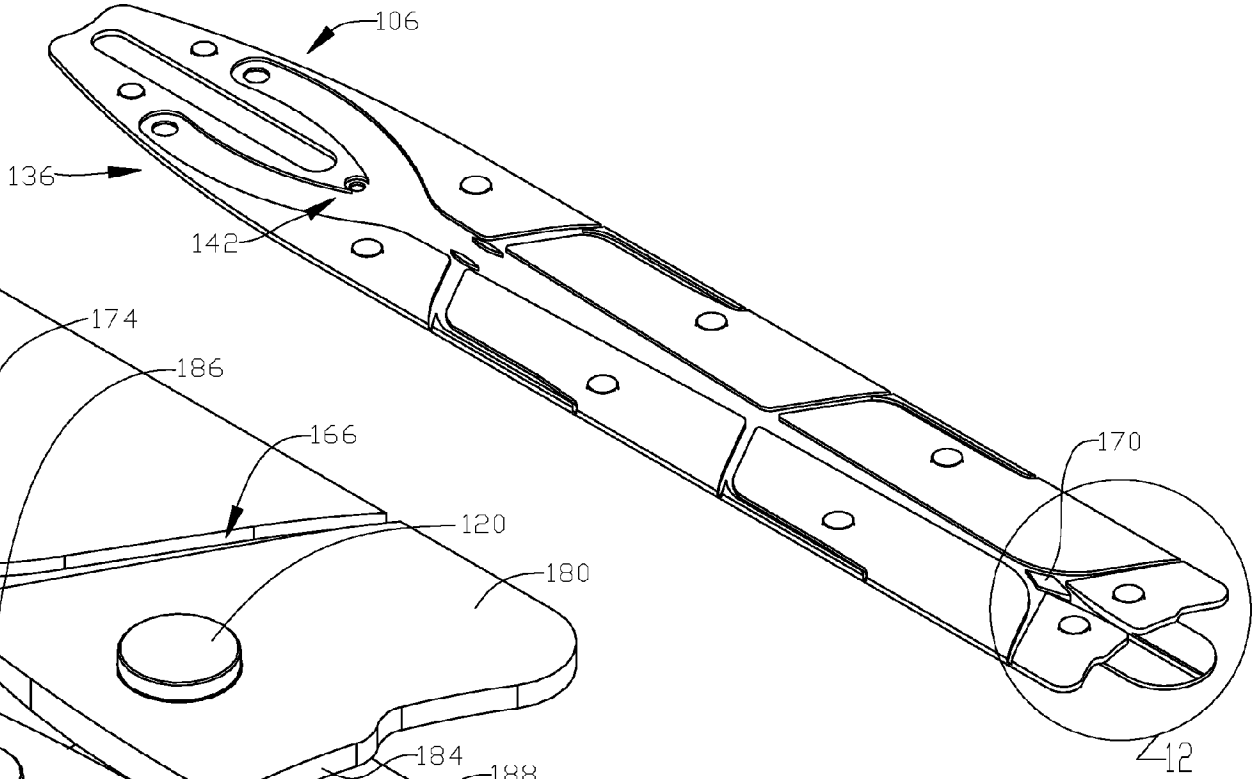
FIG. 11 is an isometric view of the core of FIG. 5.

As the central channel 146 approaches the distal end of the core, the cross-sectional flow area continues to decrease to a third flow diversion 164, in the present example. Respective side flow branches 166 having a smaller cross-sectional flow area than the flow branches 152 and 153, respectively, terminate at respective flow outlets 168 (FIGS. 6 and 9). The side flow branches 166 extend away from a flow diversion element 170 (FIGS. 6, 10, 11-13 and 17). The flow diversion element 170 may be an island, flow channel projection or block or some other element for diverting fluid flow. The flow diversion element 170 helps to promote laminar flow, helps to do for fluid flow to the side perimeter 154 of the chain bar core, and in the present example through surface tension and pressure promotes fluid flow to the nose sprocket assembly. The flow diversion element 170 includes a pair of substantially concave upstream flow surfaces 172 and a pair of downstream slightly convex surfaces 174, forming a somewhat elongated diamond-shaped island. The distal flow diversion element helps to maintain flow pressure at the distal end portion of the core.

Upstream flow islands or flow diversion elements may also be included. For example, flow diversion elements 176 (FIG. 6) are positioned substantially across the openings of the flow branches 152. These flow diversion elements 176 are narrower than the flow diversion element 117 downstream. The diversion elements 176 promote laminar flow and direct flow. The flow diversion element 176 on the opposite side of the flow inlet channel 138 from which fluid flows helps to direct flow from that side, as does the flow valve 150. For example, the flow diversion element 176 redirects fluid flow from the Inlet channel 138 along the central channel so that the newly incoming fluid flow from the opposite side inlet channel does not flow predominantly out the opposite flow branch 152. Additionally, the opposite flow diversion element 176 may help to encourage flow into the respective flow branch. Other flow diversion elements may be placed as desired to encourage or promote a desired flow pattern. Additionally, further flow outlet ports may be included in the core to improve fluid flow to the cutting chain.

Figure 12:
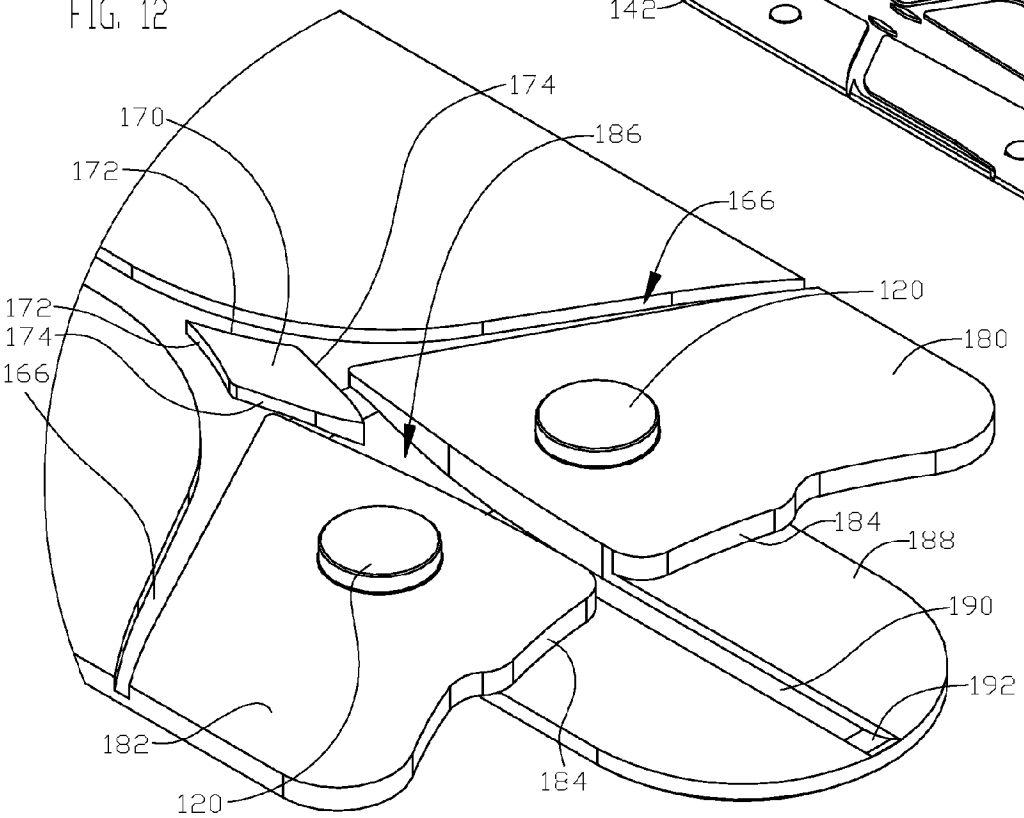
FIG. 12 is a detailed view of a portion of the core of FIG. 11.
Figure 13:
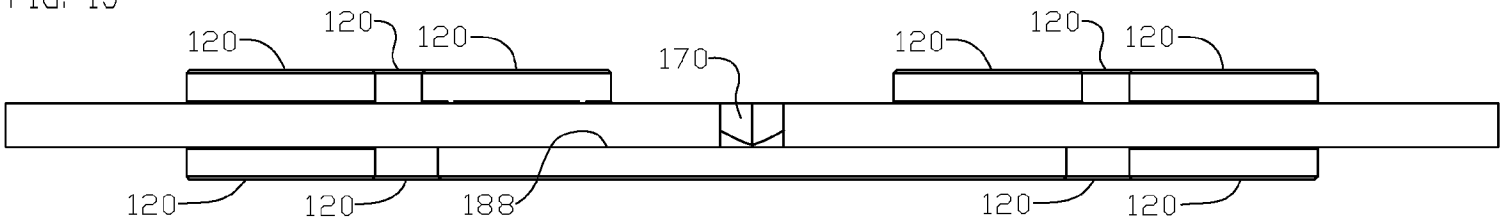
FIG. 13 is a right side view of the chain bar core of FIG. 5.

The outlet manifold 132 at the distal end portion of the core 106 includes planar panel portions 180 and 182 distal of the flow channels 166. The panel portions 180 and 182 extend substantially in the plane of the core. Bosses 120 extend upward from the respective panel portions (FIG. 12). The panel portions 180 and 182 extend distally to respective end surfaces 184 adjacent the nose sprocket.

The main flow channel leaves the diamond-shaped diversion element 170 and continues toward the nose sprocket and becomes deeper below the upper surface of the planar portions 180 and 182. The distal flow channel 186 (FIG. 12) has a depth that increases to be greater than the thickness of the planar portion of the core and into the outlet manifold 132, including that portion of the outlet manifold that extends into the plane of the second side plate 104 through the oval opening 128 (FIG. 4). The distal flow channel 186 permits fluid flow from the main flow channel underneath the nose sprocket to the bearings 124 and to the side of the nose sprocket 118. The outlet manifold includes a protruding plate 188 that extends into the oval opening. The distal flow channel 186 is formed in part in the protruding plate 188 while still being formed as part of the core 106. The distal flow channel 186 continues within the protruding plate 188 with a substantially flat bottom surface 192 and upwardly-curving surface 192 at the end of the flow channel. The upwardly-curving surface 192 forces the fluid to flow against the nose sprocket and the bearings. Other configurations of the core and/or outlet manifold can direct fluid in the area of the sprocket and bearings as desired.

The water flow channel surfaces are formed substantially smooth with a smooth finish. The remaining portions of the core 106, when formed from a plastic material, include a textured finish. The finish is a random texture that increases the surface area for bonding using adhesive or a bonding agent. The texture can be formed with a plastic part is molded, for example, or after. Molding can include a texture, such as through the technique applied by Mold-Tech. Other structures and methods may also be used for increasing bonding strength, such as cuts in the plastic or other core material described more fully herein.

The chain bar can be assembled from the first and second side plate and the core 106 by applying adhesive, for example to the second side plate over those surfaces where the core will be substantially opposite and in contact with the side plate but for the existence of the adhesive. The core is then placed against the second side plate using the bosses and the respective openings 122 for registration and alignment. The flow valve and nose sprocket assembly are placed in their respective positions relative to the core. The first side plate 102, with adhesive on that part of the surface that will come into contact with the core and bosses 120, is then placed against the core with the bosses 120 and registration with the openings 122. The nose sprocket and the fastening holes in the side plates are aligned as is conventional. The adhesive can then be cured to secure the laminate. It is noted that a plastic core 106 can be used to resist corrosion of the second side plate 104, and the adhesive on the first side plate 102 can also inhibit corrosion of the first side plate. Additionally, the adhesive can be cured with the first side plate down or on the bottom of the chain bar assembly during curing so that adhesive from the first side plate does not flow upward into the flow channels.

Figure 18:
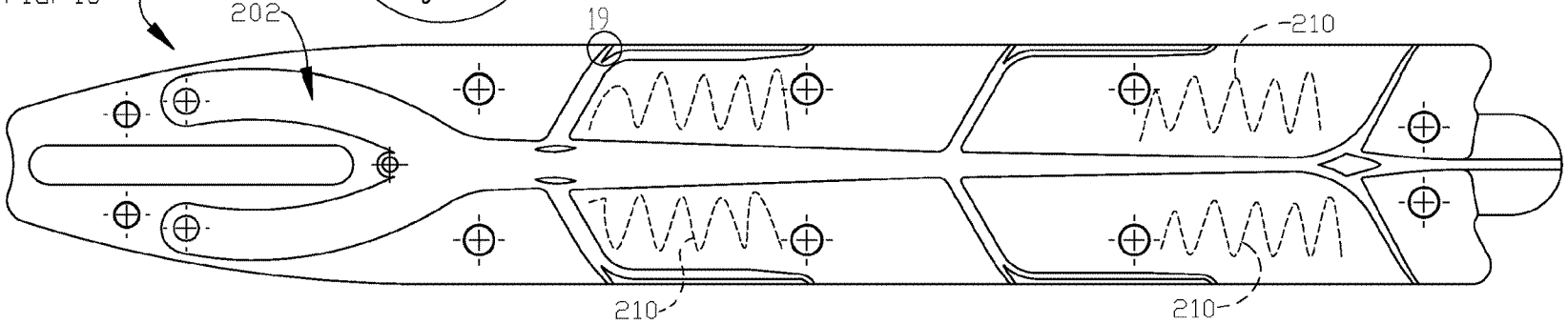
FIG. 18 is a top plan view of a chain bar core according to another example described herein.

In another example of a chain bar core that can be used with the side plates as described to form a chain bar assembly, a core 200 (FIG. 18) includes flow channels 202 that are formed completely through the entire thickness of the core. (The circles in FIG. 18 corresponding to the fluid inlet openings would not be present in the core, and the post for receiving the fluid valve 150 in the example of FIG. 4 would be supported on one of the adjacent side plate. Additionally, any islands or flow diversion elements that would be freestanding in a flow channel would be supported by one or both adjacent side plates.) The core can be formed from metal, plastic or other materials, for example by laser cutting or other forming technique.

Figure 19:
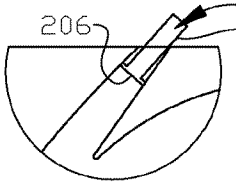
FIG. 19 is a detailed view of a portion of the core of FIG. 18.

In one example, the water channels are formed by cutting and connecting tabs such as tab 204 (FIG. 19) is maintained in the core to keep the various segments of the core coupled to each other and in the desired arrangement prior to assembly with the adjacent side plates. In the present example, the tab 204 includes a bridge portion 206 extending between adjacent spaced apart sidewalls of the corresponding flow channel and a manipulating portion 208. In the present example, the bridge portion 206 is internal to the perimeter of the core. In other examples, the bridge portion can be connected to the perimeter surface elements of the spaced apart segments forming a flow channel. The manipulating portion 208 can be used to remove the bridge portion 206 at the desired time, for example when the core 200 has been applied to an adjacent side plate, for example through adhesive. Each of the outlet ports can include respective tabs for maintaining the various otherwise separate core segments in their desired orientation with respect to each other. Additionally, tabs can be used to position islands or flow diversion elements as desired until such time as the core elements are positioned relative to a side plate. When a core assembly is ready to be applied to an adjacent side plate, for example through adhesive, the core and the side plate can be combined and the tabs removed. Thereafter, the opposite side plate can be applied to form the assembly and the adhesive cured. In this example, the depth of the flow channels extends the entire thickness of the core. In this example also, if desired, the portions of the outlet manifold 132 in the embodiment of FIGS. 4-17 outside the plane of the core can be omitted.

In any of the core examples described herein, flow channels and other core components can be formed by cutting, for example laser cutting. Additionally, the complementary openings 120 as well as other openings such as the channel 110 can be formed in the side plates by laser cutting or other cutting means. A core can also have laser cut or other formed openings through the core to assist in strengthening the resulting chain bar. For example, in the example of the core 200 shown in FIG. 18, serpentine laser cut lines 210 are formed in the core 200 forming passageways extending through the thickness of the core. The lines 210 are each a closed-circuit, and do not extend to an outer perimeter of the core. These lines are nonlinear longitudinally and transversely of the core. The lines in the present example are noncircular, and spaced apart sidewalls have substantially the same spacing. Additionally, the spacing between sidewalls is substantially the same from one end of the opening to the other. On assembly, for example with an adhesive to bond the layers together, adhesive enters the openings of the lines 200, and may even extend completely through the thickness of the core, and between the spaced apart sidewalls. Such adhesive pocketed cuts or lines improve the sheer strength of the chain bar.

Figure 3A:
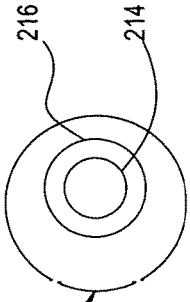
FIG. 3A is a partial detailed view of an LED light source on a side of the chain bar assembly of FIG. 3.

In any of the core examples described herein, lighting components may also be included or otherwise adapted for illumination through the chain bar for illuminating the surrounding area. For example, LEDs can be mounted on the side plates, for example three per side, and set into respective openings in the side plates (representative single LEDs 212 and 214 of which are shown in FIGS. 2 and 3, respectively, and LED 214 is shown in an opening 216 more easily seen in the detail FIG. 3A). In addition, or alternatively, light sources in the chainsaw motor housing can illuminate the chain bar, and a translucent side plate or side plates can transmit light from such light sources to the surrounding area. Translucent materials may include polycarbonate and Lexan. Current may be provided to LEDs or other light sources through conductors embedded in the core such as a plastic core, or in flow paths in the core. Current may be generated by a generator producing current arising from fluid flow past the generator. Alternatively, a battery or other energy source may be embedded in the chain bar, for example in the core or a side plate. Lighting can be turned on through a manually accessible switch, or a detent switch adjacent the chain that is activated through chain motion. Alternatively, power can be obtained from the chainsaw, such as through a spark plug or other electrical source.

Having thus described several exemplary implementations, it will be apparent that various alterations and modifications can be made without departing from the concepts discussed herein. Such alterations and modifications, though not expressly described above, are nonetheless intended and implied to be within the spirit and scope of the inventions. Accordingly, the foregoing description is intended to be illustrative only.

What is claimed is:

1. A chain bar assembly for a chainsaw, the chain bar assembly including at least one side plate wherein the at least one side plate helps to define a channel for receiving and guiding a chain, and a light source supported at the at least one side plate and configured to allow light from the light source to be directed perpendicular to the side plate.

2. The chain bar assembly of claim 1 where the light source is an LED light source mounted in and supported through an opening in the at least one side plate.

3. The assembly of claim 1 wherein the light source is mounted on the at least one side plate.

4. The assembly of claim 1 wherein the at least one side plate includes first and second side plates, and wherein a light source is mounted on each of the first and second side plates.

5. The assembly of claim 1 wherein the at least one side plate includes a wall defining an opening and wherein a portion of the light source extends into the opening.

6. The assembly of claim 1 wherein the light source includes first, second and third light sources.

7. The assembly of claim 6 wherein the first, second and third light sources are mounted on the at least one side plate.

8. The assembly of claim 6 wherein the first, second and third light sources are set into respective openings in the at least one side plate.

9. The assembly of claim 6 wherein the at least one side plate is a first side plate and the assembly includes a second side plate, and wherein the second side plate includes first, second and third light sources.

10. The assembly of claim 1 wherein the at least one side plate is configured to transmit light.

11. The assembly of claim 1 wherein the at least one side plate is translucent.

12. A chain bar assembly for a chainsaw, the chain bar assembly including a core and an outer plate and LED light sources embedded into openings in a side of the chain bar assembly.

13. The chain bar assembly of claim 12 wherein the openings in the side of the chain bar assembly are openings in the outer plate.

14. The chain bar assembly of claim 13 wherein the outer plate is a first outer plate and further including a second outer plate and further including LED light sources embedded into openings in the second outer plate.

15. The chain bar assembly of claim 12 wherein the outer plate is a first outer plate and further including a second outer plate on the core, and wherein the LED light sources are embedded into the openings in the first outer plate and further including second LED light sources embedded into openings in the second outer plate.

16. A chain bar assembly comprising a chain bar and LED light sources mounted at portions of the chain bar and configured such that light from the LED light sources can be emitted in a direction perpendicular to a side of the chain bar.

17. The chain bar assembly of claim 16 wherein the chain bar includes a side surface having openings and wherein the LED light sources are embedded in the openings in the side surface of the chain bar.

18. The chain bar assembly of claim 16 wherein the chain bar includes first and second side plates and the LED light sources extend in openings in at least one of the first and second side plates.

* * * * *